US007293646B2

(12) United States Patent
Masuda et al.

(10) Patent No.: US 7,293,646 B2
(45) Date of Patent: Nov. 13, 2007

(54) PLURAL-CHAMBER CONTAINER

(75) Inventors: Toshiaki Masuda, Osaka (JP); Hiroshi Fukushima, Osaka (JP); Hiroshi Todo, Osaka (JP)

(73) Assignee: Nipro Corporation, Osaka (JP)

( * ) Notice: Subject to any disclaimer, the term of this patent is extended or adjusted under 35 U.S.C. 154(b) by 52 days.

(21) Appl. No.: 10/534,491

(22) PCT Filed: Oct. 30, 2003

(86) PCT No.: PCT/JP03/13959

§ 371 (c)(1),
(2), (4) Date: May 10, 2005

(87) PCT Pub. No.: WO2004/043327

PCT Pub. Date: May 27, 2004

(65) Prior Publication Data

US 2006/0065565 A1 Mar. 30, 2006

(30) Foreign Application Priority Data

Nov. 11, 2002 (JP) ..... 2002-327173

(51) Int. Cl.
*B65D 25/08* (2006.01)

(52) U.S. Cl. ..... 206/219; 206/438; 206/459.1

(58) Field of Classification Search ..... 206/219, 206/220, 568, 438, 459.1, 459.5
See application file for complete search history.

(56) References Cited

U.S. PATENT DOCUMENTS 4,709,396 A * 11/1987 Voshall et al. ..... 206/459.1
4,961,495 A * 10/1990 Yoshida et al. ..... 206/219
5,064,664 A * 11/1991 Hustad et al. ..... 206/459.1
5,501,887 A * 3/1996 Tanaka et al. ..... 206/219
6,017,598 A * 1/2000 Kreischer et al. ..... 206/219
6,484,874 B1 * 11/2002 Kageyama et al. ..... 206/219
6,491,159 B2 * 12/2002 Shibata ..... 206/219
2002/0066678 A1 * 6/2002 Sharon et al. ..... 206/219

FOREIGN PATENT DOCUMENTS

| | | |
|---|---|---|
| JP | 59-192527 | 7/1986 |
| JP | 6-26563 B2 | 4/1994 |
| JP | 2000-005275 A | 1/2000 |
| JP | 2000-262589 A | 9/2000 |

* cited by examiner

*Primary Examiner*—Luan K Bui
(74) *Attorney, Agent, or Firm*—Kubovcik & Kubovcik

(57) ABSTRACT

A plural-chamber container capable of indicating whether or not a peelable partition wall is peeled and hence a medical professional can quickly become aware of a state of communication among respective chambers when using the plural-chamber container, wherein the plural-chamber container formed of a synthetic resin film and a plurality of chambers compartmentalized by a peelable partition wall formed by thermally welding part of the opposed films, characterized in that a means capable of indicating the peeling of the partition wall is provided on a surface of the plural-channel container.

2 Claims, 7 Drawing Sheets when partition wall is formed sign indicating portion sign shielding portion when partition wall is formed sign indicating portion sign shielding portion

PLURAL-CHAMBER CONTAINER

This application is a 371 of international application PCT/JP2003/013959, which claims priority based on Japanese patent application No. 2002-327173 filed Nov. 11, 2002, which is incorporated herein by reference.

TECHNICAL FIELD

The present invention relates to a container having a plurality of chambers storing medicaments therein, in which the plurality of medicaments can be mixed before usage by opening a partition wall which compartmentalizes the plurality of chambers to communicate the plurality of chambers. More specifically, the present invention relates to a container with which a medical professional can become aware of a fact that a plurality of chambers is in communication for mixing medicaments by opening of a partition wall (a weak sealed portion).

RELATED ART

In the past, a plural-chamber container formed of a synthetic resin film has been used for mixing a medicament or medical solution, which is deteriorated in preservability by a change of properties or the like in a mixed state, in an aseptic condition before usage. It is adapted to separately store a plurality of contents in a plurality of chambers compartmentalized by an easy peelable partition wall, and to allow the partition wall to be peeled by pressing the container in which the contents are stored prior to usage from the outside by hand for mixing the contents by communicating the plurality of chambers in the aseptic condition (For example, see JP-B-6-26563).

However, such a plural-chamber container includes a discharge port in one of the plurality of chambers, and hence administration of a medical solution can be performed even when the peeling of the partition wall has not been done. Consequently, there is a risk of administering the medical solution to the patient while forgetting to mix the contents stored in the respective chambers.

Therefore, in order to solve the above-described problem, there is developed a container having a artifice to attract the medical professional's consciousness to the position in the vicinity of the partition wall when using the plural-chamber container (for example, see JP-A-2000-5275). This container is provided with a chamber compartmentalized by the partition wall within a hanger hole of the container. Since the medical professional checks the hanger hole when hanging the container for using the plural-chamber container, he/she can consequently check whether or not the partition wall has been peeled and thus that the respective chambers are communicating.

However, the aforementioned plural-chamber container is intended to prevent the medical professional from forgetting to communicate medicament chambers of specifically small capacity, and hence there is a limit in the capacity of the chambers which can be provided within the small hanger hole.

Also, there is a case where the medical professional who is in charge of treatment of a plurality of patients, may leave to perform other work and hence he/she may restart the preparation of the plural-chamber container even though he/she once started the preparation for use, or another medical professional may take over the preparation for use. In such cases, there is a risk of mistaking that the peeling of the partition wall has been completed and starting administration of the medical solution to a patient in a state in which the plurality of chambers are not communicating. Although the aforementioned plural-chamber container can attract the medical professional's attention to the partition wall, whether or not the partition wall is peeled and hence the respective chambers are communicating cannot be quickly confirmed.

In view of above-described circumstances, it is an object of the present invention to provide a plural-chamber container which indicates whether or not a peelable partition wall is peeled so that a medical professional can quickly become aware of the state of communication among the respective chambers when using the plural-chamber container.

DISCLOSURE OF THE INVENTION

After having assiduously conducted various investigations in order to solve the problems described above, the present inventors have consequently found a plural-chamber container which can solve the above-described problem by providing a means capable of indicating that a partition wall has been peeled on an outer surface of the plural-chamber container on a partition wall forming portion of the opposed films.

That is, the present invention is a plural-chamber container formed of a synthetic resin film and compartmentalized into a plurality of chambers by a peelable partition wall formed by thermally welding opposed parts of the films, characterized by comprising a means capable of indicating the peeling of the partition wall provided on an outer surface of the plural-chamber container.

The plural-chamber container of the present invention is compartmentalized into a plurality of chambers by a peelable partition wall, and respectively accommodates a medicament or medical solution which cannot be conserved in a mixed state. When using the plural-chamber container, the partition wall is peeled, for example, by pressing the respective chambers from the outside to allow the respective chambers to communicate with each other so that the medicaments or medical solutions stored in the respective chambers are mixed. At this time, the partition wall forming portion of the film which forms the plural-chamber container according to the present invention is provided with a means for indicating that the partition wall is peeled on the outer surface of the plural-chamber container and the medical professional can become aware of the fact that the respective chambers are communicating with each other simultaneously with the peeling of the partition wall. Since there is provided the means for indicating the peeling of the partition wall on the plural-chamber container, even when the medical professional leaves the plural-chamber container once in the process of preparation for using the plural-chamber container and then the same person or another person starts again the preparation for using the same, the medical professional can quickly become aware of whether or not the respective chambers of the plural-chamber containers are communicating with each other.

BEST MODE FOR CARRYING OUT THE INVENTION

A plural-chamber container according to the present invention will be described in detail in accordance with preferred embodiments shown in the attached drawings. However, the present invention is not limited to these descriptions.

Figure 1:
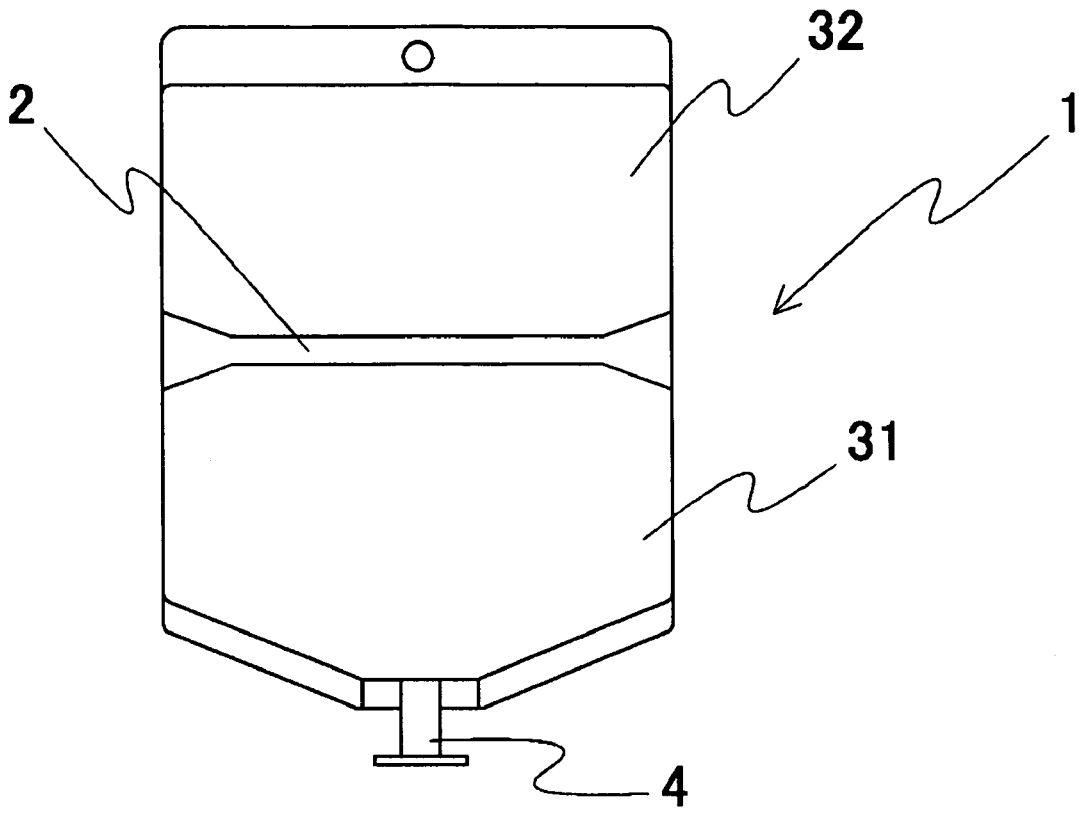
FIG. 1 is a plan view showing an embodiment of a plural-chamber container according to the present invention.

As shown in FIG. 1, a plural-chamber container 1 according to the present invention is compartmentalized, for example, into two chambers 31, 32, by a peelable partition wall 2, and one chamber 31 is provided with a discharge port 4 for discharging medicament or medical solution from the plural-chamber container. The number of chambers provided in the plural-chamber container 1 may be changed depending on the number of types of medicament or medical solution to be mixed. The number, the position, and the shape of the discharge port are also changed as needed depending on the type or the usage of the medical solution to be prepared in the plural-chamber container.

The plural-chamber container 1 is formed of a synthetic resin film. The synthetic resin includes polyolefins such as polyethylene and polypropylene, or partly cross-linked substances thereof, ethylene-vinyl acetate copolymers, polyesters, soft polyvinyl chlorides, or compounds or copolymers thereof. The aforementioned synthetic resin film may include heat stabilizers, antioxidants, or UV absorbers in addition to the synthetic resin, or may be one applied with a surface treatment such as ozone treatment, corona treatment and vapor deposition treatment.

The synthetic resin film may be a single-layer film or a plural-layer film. Preferably, the single-layer film has a thickness of 5-500 μm and is fabricated by a method used for a general thermoplastic resin such as T-die molding or inflation molding. Preferably, the plural-layer film has a thickness of 10-500 μm, and the film is fabricated by a method such as co-extrusion molding, dry-lamination, or extrusion coating.

The synthetic resin is formed into a cylindrical or a plate-shaped film (or sheet) by the molding method described above. The peelable partition wall 2 is formed by thermally welding opposed parts of the films after cutting into a suitable length in the case of the cylindrical film, or after superimposing two films and in the case of the plate-shaped film (or sheet). The thermal welding is performed at a temperature which is higher than the melting point of one of the components having the lowest melting point contained in the innermost film and which is lower than the melting point of another one of the components having the highest melting point.

The plural-chamber container 1 is formed, for example, by thermally welding the edges of the cylindrical film or the two plate-shaped films having the partition walls 2 formed thereon so as not to be peelable at a temperature higher than the melting point of one of the components having the highest melting point contained in the innermost film. The plural-chamber container 1 is ordinary provided with a medical solution discharge port in either one of the chambers 31, 32. As the method of thermal welding, a method such as welding by a heated mold, ultrasonic welding or high-frequency welding is used.

In the plural-chamber container 1 formed by the above-described method, the contents are filled before thermal welding of the edges, or after thermal welding of the edges through an opening such as the discharge port 4. In addition to a dialysate for artificial kidney, a displacement liquid for a filter type artificial kidney, or a transfusion product, the contents are not limited to liquid, and may be powder or a solid.

The aforementioned plural-chamber container 1 is used by compressing either one of the chambers 31, 32 compartmentalized by the partition wall 2 from the outside with a hand or the like to peel the partition wall 2 and communicate the plurality of chambers 31, 32 so that the plurality of contents are mixed.

Figure 2:
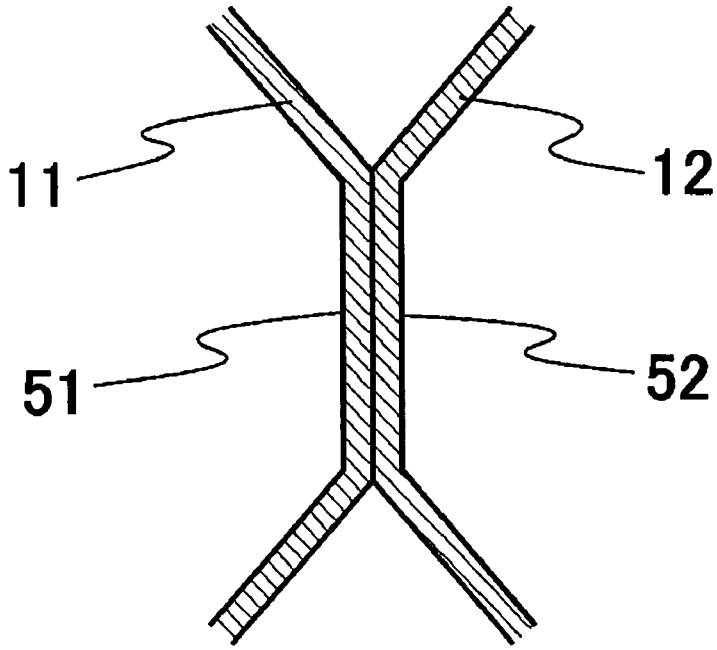
FIG. 2 is an enlarged cross-sectional view showing an embodiment of a partition wall portion of the plural-chamber container according to the present invention.

The plural-chamber container 1 according to the present invention is provided with means capable of indicating the peeling of the partition wall at the partition wall forming portions on both of films 11 and 12 opposed to each other as shown in FIG. 2. The means capable of indicating the peeling of the partition wall comprises a means on an outer surface of the plural-chamber container 1 for indicating that the partition wall 2 of the plural-chamber container 1 is peeled only when it has occurred.

As an example of such means, there is the one including a sign indicating portion 51 provided on the partition wall forming portion on one (11) of the opposed films, and a sign shielding portion 52 provided on the partition wall forming portion on the other one (12) of the opposed films. When the aforementioned partition wall 2 is formed, that is, when the opposed films 11 and 12 are superimposed, the sign indicating portion 51 and the sign shielding portion 52 are also superimposed, and hence the sign on the sign indicating portion 51 is prevented from being shown on the outer surface of the plural-chamber container 1 by the sign shielding portion 52. On the other hand, when the partition wall 2 is peeled, that is, when the opposed films 11 and 12 are separated from each other, the sign indicating portion 51 and the sign shielding portion 52 are also separated from each other, and the sign on the sign indicating portion 51 is indicated on the outer surface of the plural-chamber container. Accordingly, the medical professionals can become aware of the fact that the partition wall 2 is peeled and thus that the plurality of chambers are communicating with each other, if the plural-chamber container 1 is positioned in any case, such as being placed or being hung.

A detailed example of the means capable of indicating the aforementioned peeling of the partition wall provided on the outer surface of the plural-chamber container will be described based on FIGS. 4 to 8.

Figure 4:
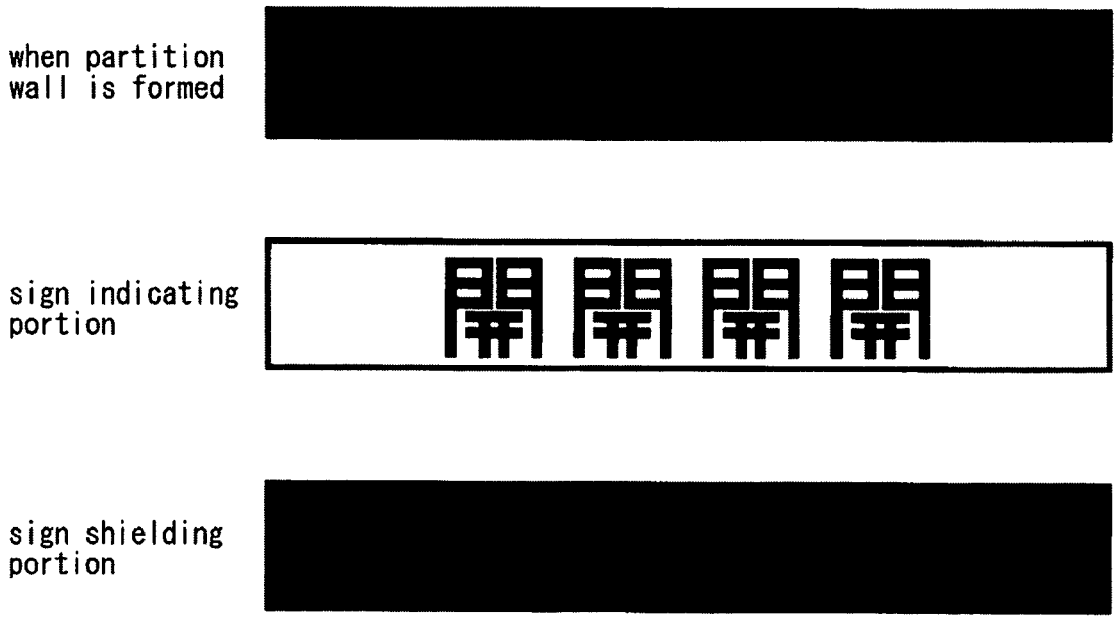
FIG. 4 is a diagram showing an embodiment of the means which can indicate the peeling of the partition wall provided in the plural-chamber container according to the present invention (each of the Japanese characters in the "sign indicating portion" means "OPEN").

As an embodiment of the means capable of indicating the peeling of the partition wall, as shown in FIG. 4, the partition wall forming portion on one (11) of the opposed films is provided with sign indicating portion 51 on which characters meaning "OPEN", which indicate that the plurality of chambers in the plural-chamber container 1 are in communication with each other, are printed. Also, on the partition wall forming portion on the other (12) of the opposed films, sign shielding portion 52, which fills up an area larger than the area on which the sign is printed with the same color as the sign, is provided so as to shield the sign on the sign indicating portion 51.

When the partition wall 2 is formed, that is, when the opposed films 11 and 12 are superimposed, the sign indicating portion 51 and the sign shielding portion 52 are also superimposed, and hence the characters meaning "OPEN" on the sign indicating portion 51 are invisible due to the filling up of the sign shielding portion 52. On the other hand, when the partition wall 2 is peeled, that is, when the opposed films 11 and 12 are separated from each other, since the sign indicating portion 51 and the sign shielding portion 52 are also separated from each other, the characters meaning "OPEN" on the sign indicating portion 51 are shown on the outer surface of the plural-chamber container 1. The medical professional can become aware of the characters meaning "OPEN" shown on the outer surface of the plural-chamber container 1, and quickly recognize that the partition wall 2 is peeled and hence the plurality of chambers are in communication with each other.

Figure 6:
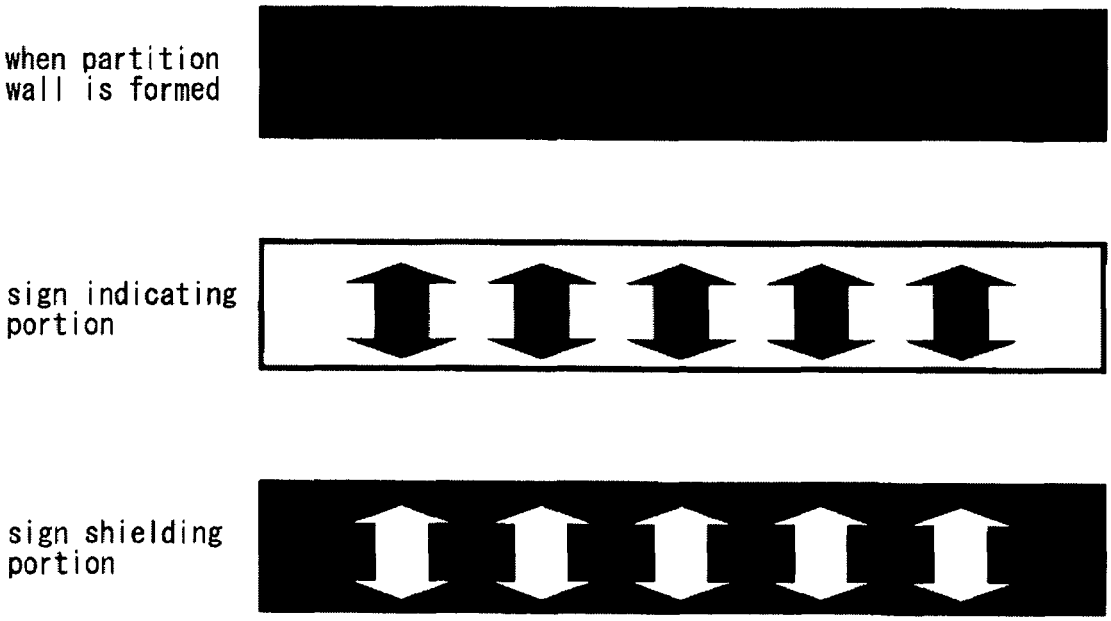
FIG. 6 is a diagram showing still another embodiment of the means which can indicate the peeling of the partition wall provided in the plural-chamber container according to the present invention.

The sign on the aforementioned sign indicating portion 51 is not limited to Japanese signage such as the characters shown in FIG. 4, but may be English signage such as "OPEN", or may be a drawing such as arrows as shown in FIG. 6 other than the characters, and is not specifically limited as long as it is a sign which quickly allows a medical professional to become aware that the partition wall is peeled or the plurality of chambers are in communication with each other.

Figure 5:
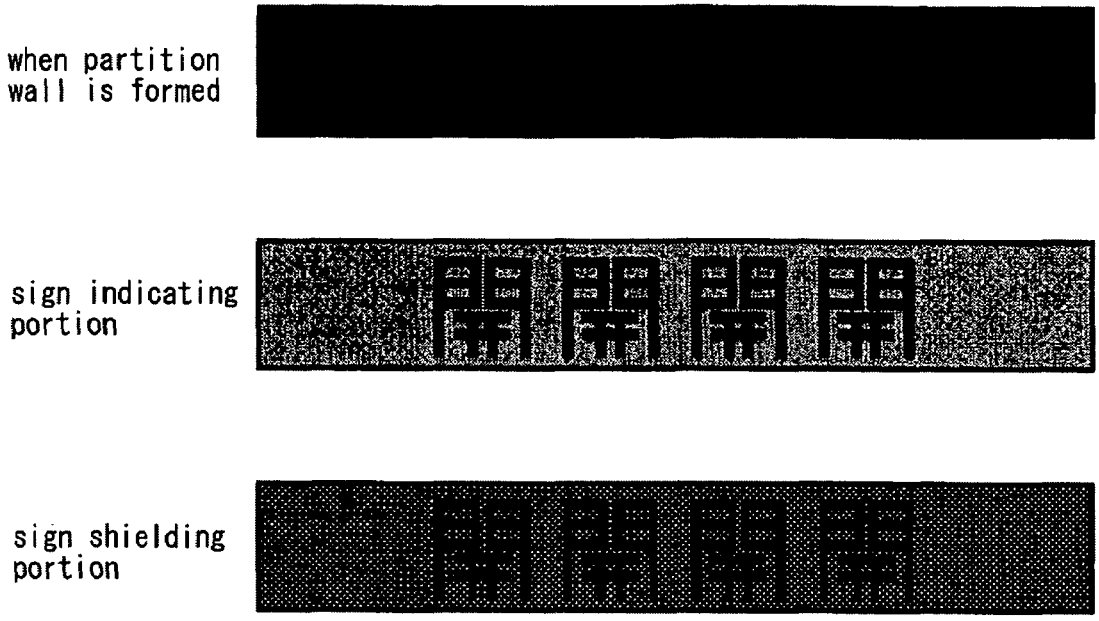
FIG. 5 is a diagram showing still another embodiment of the means which can indicaLe the peeling of the partition wall provided in the plural-chamber container according to the present invention (each of the Japanese characters in the "sign indicating portion" means "OPEN").

Another means which can indicate the aforementioned peeling of the partition wall is shown in FIG. 5. That is, in addition to the sign indicating that the partition wall 2 is peeled, or that the plurality of chambers are in communication with each other, a mesh pattern is printed on the sign indicating portion 51 as a background, and a pattern which fills gaps in the mesh pattern as the background of the sign indicating portion 51 is printed on the sign shielding portion 52.

With such means, the sign on the sign indicating portion 51 is not shown when the partition wall 2 is formed, while the sign is shown on the outer surface of the plural-chamber container 1 for the first time when the partition wall 2 is peeled.

As another example of the means capable of indicating that the partition wall is peeled, there is the one as shown in FIG. 6. That is, the sign is printed on the sign indicating portion 51, and a drawing which corresponds to the outline of the sign on the sign indicating portion 51 is printed on the sign shielding portion 52.

With such means, not only the sign on the sign indicating portion 51, but also the sign on the sign shielding portion 52 are shown, and hence it is possible to quickly become aware of the fact that the partition wall is peeled or that the plurality of chambers are in communication with each other both from the front side and the back side of the plural-chamber container 1. The same effects are achieved not only when the drawing which corresponds to the outline of the sign indicating portion 51 is printed on the sign shielding portion 52 as shown in FIG. 6, but also when the sign on the sign indicating portion 51 is printed thereon in the case where the background of the sign shielding portion 52 is not filled up as shown in FIG. 5.

Figure 7:
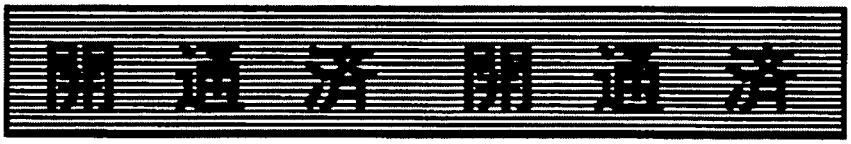
FIG. 7 is a diagram showing still another embodiment of the means which can indicate the peeling of the partition wall provided in the plural-chamber container according to the present invention each set of three Japanese characters in the "sign indicating portion" means "OPENED").
Figure 7:
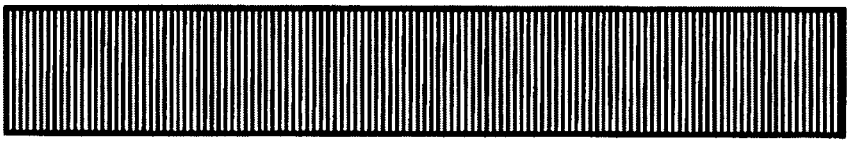

Still another means capable of indicating the peeling of the partition wall is shown in FIG. 7. That is, a plurality of lines disposed in parallel in one direction are printed on the sign indicating portion 51 as a background in addition to the sign, and a plurality of lines disposed in parallel in a different direction from the lines used as the background on the sign indicating portion 51, more preferably, in a direction which perpendicularly intersects with the aforementioned lines are printed on the sign shielding portion 52.

In this manner, the sign shielding portion 52 is not necessarily required to completely shield the sign on the sign indicating portion 51 as shown in FIG. 5 and FIG. 6, and may shield to an extent that the sign cannot be viewed.

Figure 8:
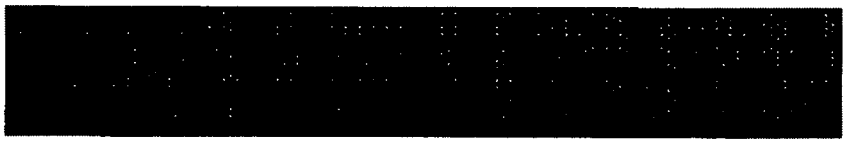
FIG. 8 is a diagram drawing showing still another embodiment of the means which can indicate the peeling of the partition wall provided in the plural-chamber container according to the present invention.
Figure 8:
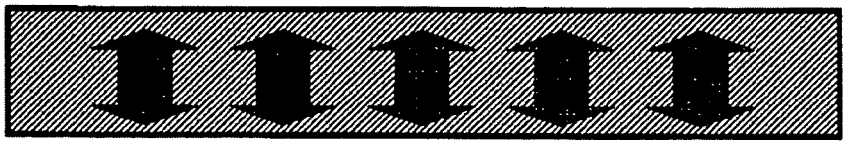
Figure 8:
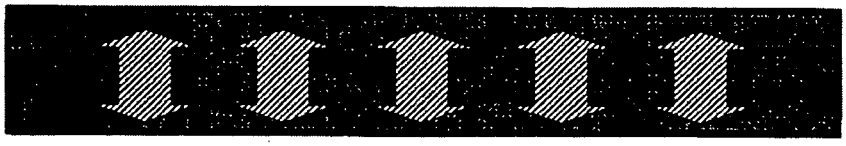

As the means capable of indicating the aforementioned peeling of the partition wall there may be included means as shown in FIG. 8, in which the sign itself on the sign indicating portion 51 in FIG. 6 is modified into the meshing pattern and the outlined portion of the sign on the sign shielding portion is modified into a pattern filling up the gaps among the meshing pattern of the sign indicating portion.

With such means as well, both of the sign indicating portion 51 and the sign shielding portion 52 indicate signs, and hence it is possible to be quickly aware of the fact that the partition wall is peeled or that the plurality of chambers is in communication with each other both from the front side and back side of the plural-chamber container 1.

As described above, in the embodiments of means capable of indicating the peeling of the partition wall shown in FIG. 4 to FIG. 8, the colors of the sign and the background on the sign indicating portion 51 and the sign shielding portion 52 are not specifically limited, but it is preferable to use a dark color which can easily shield the sign by the sign shielding portion 52 or a distinctive color which allows the medical professional to become aware of it as soon as possible. When the colors of the sign and the background are the same color, the darkness can be differentiated.

The area forming the aforementioned sign indicating portion 51 and the sign shielding portion 52 is not specifically limited as long as it is included in the partition wall forming portions on the opposed films, but is preferably large enough not to restrict the medical professional's awareness.

The method of printing the aforementioned sign indicating portion 51 and the sign shielding portion 52 employed here is a printing method used for conventional films or containers, including gravure printing, offset printing, hot stamp, and inkjet printing.

Figure 3:
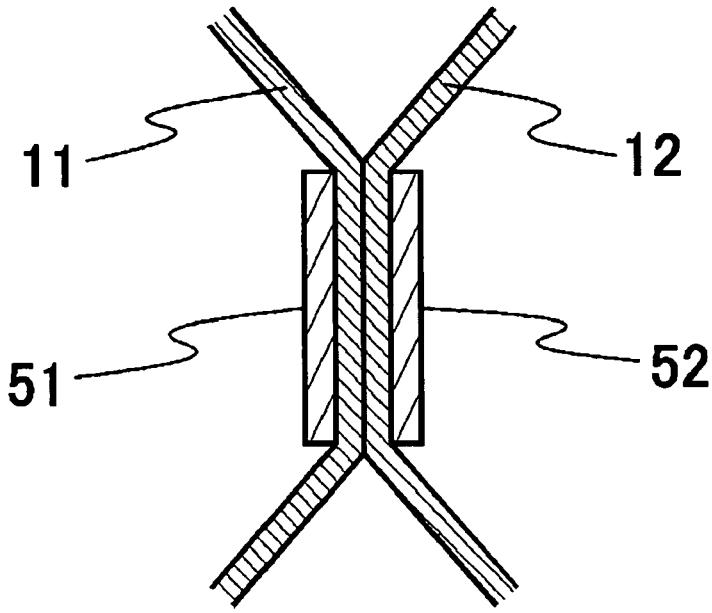
FIG. 3 is an enlarged cross-sectional view showing another embodiment of the partition wall portion of the plural-chamber container according to the present invention.

The sign indicating portion 51 and the sign shielding portion 52 shown in FIG. 4 to FIG. 8 may be manufactured by directly printing on the outer surface of the partition wall forming portions of the opposed films 11 and 12 as shown in FIG. 2, or may be manufactured by adhering separately prepared films which are printed in advance on the outer surfaces of the partition wall forming portions of the opposed films 11 and 12 as shown in FIG. 3. As the adhering method, a commonly used method such as adhesion by thermal welding or with an adhesive agent is used.

The process such as the aforementioned printing and adhering may be carried out before or after welding the partition wall forming portion of the plural-chamber container.

As another embodiment of the present invention, a plural-chamber container capable of easily confirming a state of communication, having a weak seal which is easy peelable by pressing from the outside and being pouch compartmentalized to a plurality of chambers with the weak seal as a partition wall. In the plural-chamber container, a two-color portion which is colored at an upper side and an under side with respectively different colors on the adjacent positions of a front side and a back side of films comprising the weak sealed portion, and the upper color of the two-color portion on one side can respectively hides the under side color of the two-color portion and the under side color of the two-color portion on the other side.

The two-color portion of the front side and the two-color portion of the back side may have the same combination of the color at the upper side and the under side. As such a combination, a combination in which the upper side is colored white and the under side is colored red in order that the weak sealed portion is cleanly impressed before peeling and is conspicuous after peeling is preferable. Additionally, the two-color portion may be disposed along the weak sealed portion. The two-color portion may be provided on the film per se comprising the weak sealed portion or provided on the surface of the film comprising the weak sealed portion. In the case that the two-color portion is provided on the surface of the film, the two-color portion may be formed by applying the different colors at an upper side and an under side on the surface of the film or formed by adhering a tape having different colors at a front side and a back side on the surface of the film.

Figure 9:
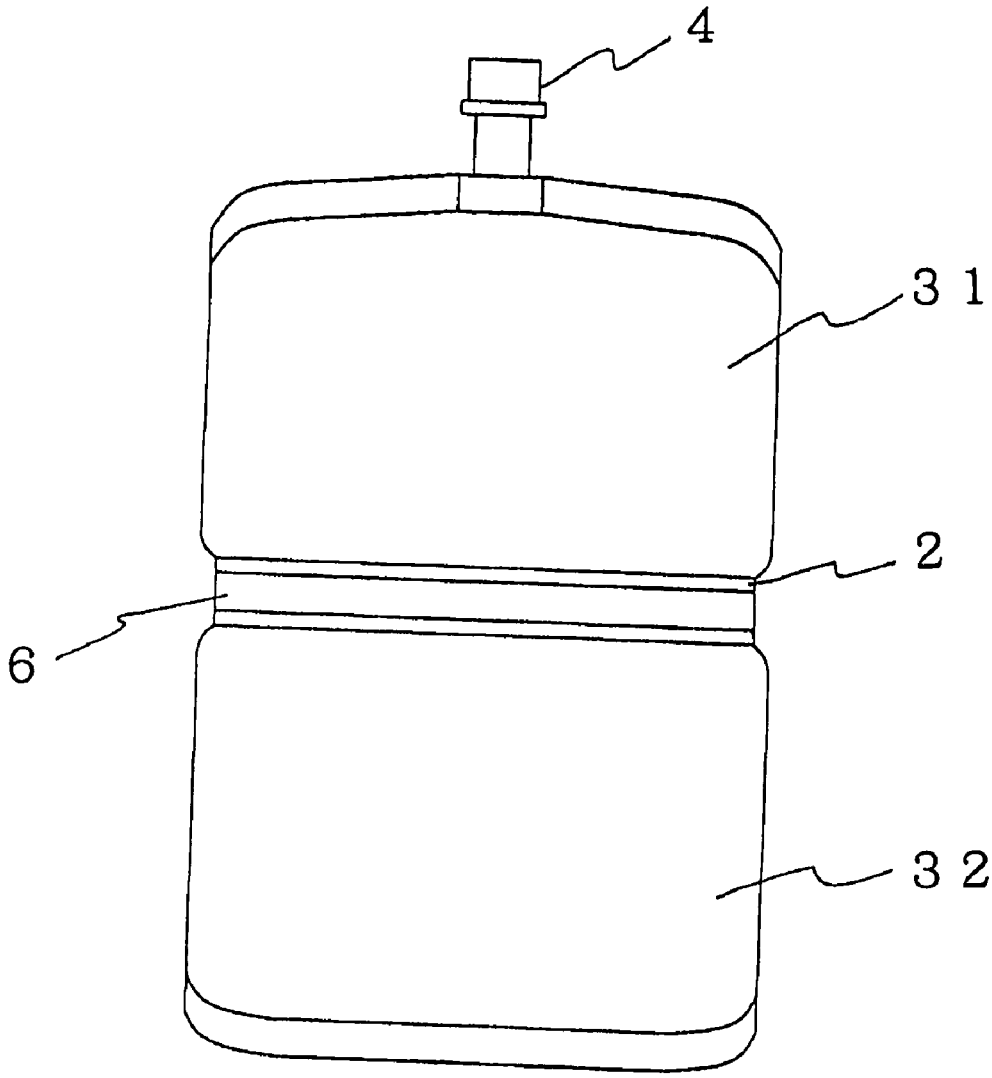
FIG. 9 is a plan view showing another embodiment of the plural-chamber container according to the present invention and shows a plural-chamber container having two chambers.
Figure 10:
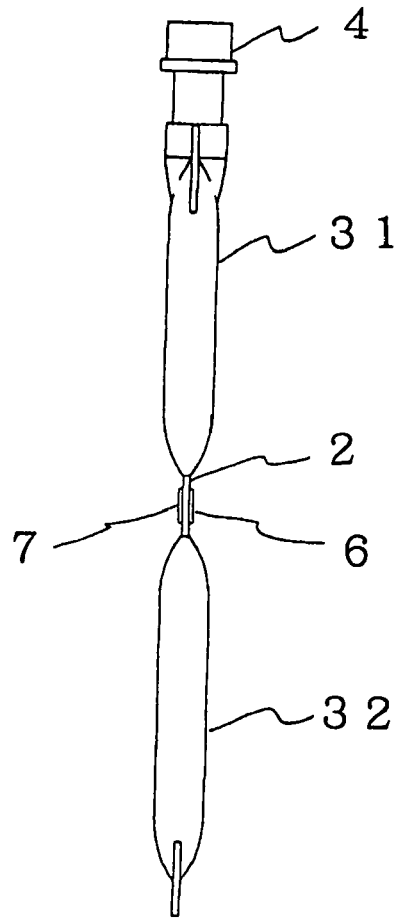
FIG. 10 is a side view of the plural-chamber container shown in FIG. 9.
Figure 11:
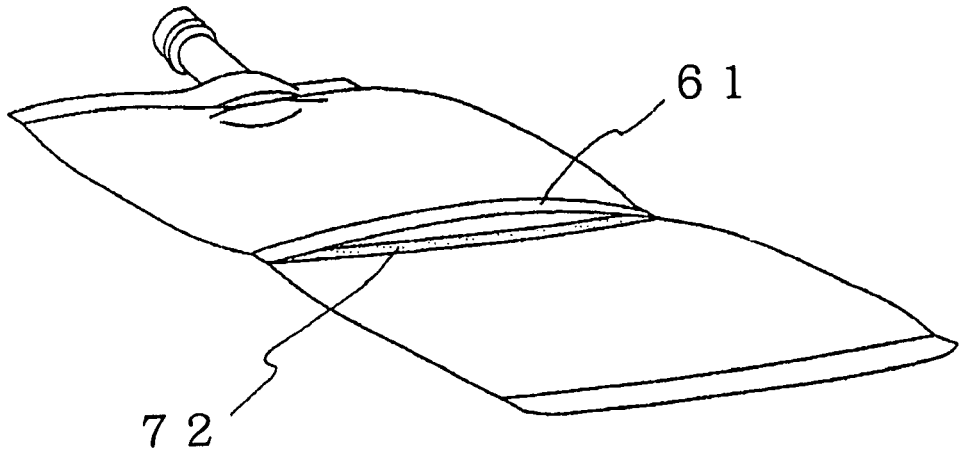
FIG. 11 is a perspective view showing a state that a partition wall of the plural-chamber container shown in FIG. 9 is peeled and two chambers are communicating with each other (showing a state being pressed while a front side is turned up).
Figure 12:
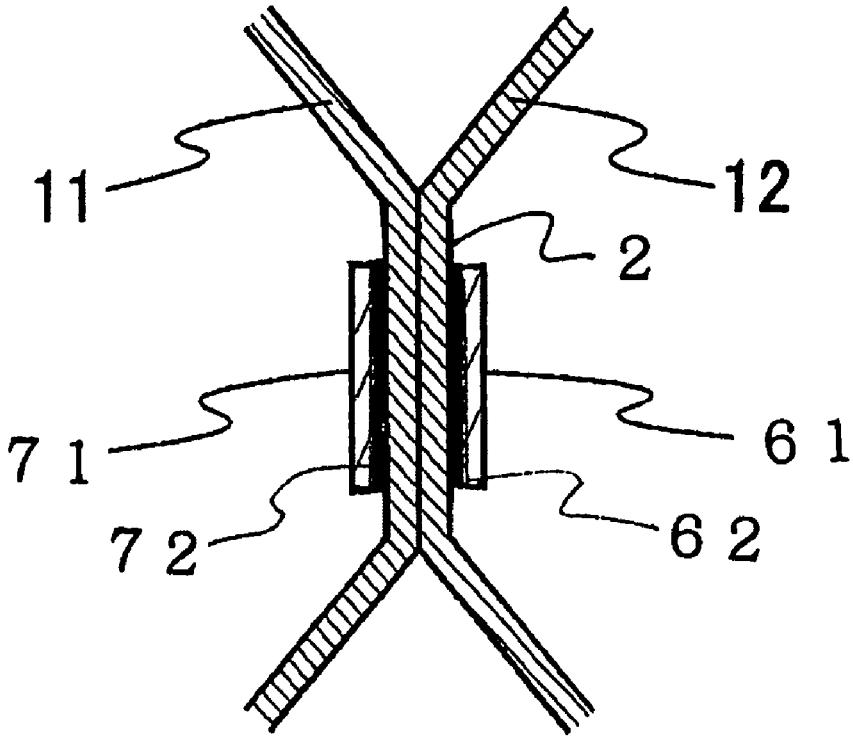
FIG. 12 is an enlarged cross-sectional view showing a partition wall portion of the plural-chamber container shown in FIG. 9.

FIG. 9 is a plan view showing another embodiment of the plural-chamber container according to the present invention and shows a plural-chamber container having two chambers. Additionally, FIG. 10 is a side view of the plural-chamber container shown in FIG. 9 and FIG. 11 is a perspective view showing a state that a partition wall of the plural-chamber container shown in FIG. 9 is peeled and two chambers are communicated with each other (showing a state being pressed while a front side is turned up). FIG. 12 is an enlarged cross-sectional view showing a partition wall portion of the plural-chamber container shown in FIG. 9.

As shown in FIGS. 9 and 10, the plural-chamber container of the present invention has a weak sealed portion 2 which is easy peelable by pressing from the outside, and is compartmentalized into a first chamber 31 storing medical solution and a second chamber 32 capable of storing not only a medical solution but also a dry medicament such as a powder medicament or a solid medicament using the weak sealed portion 2 as a partition wall. The two-color portions 6 (61 and 62) and 7 (71 and 72) are respectively provided on the adjacent position at the front side and the back side of the films comprising the weak sealed portion 2 (see FIG. 12), and the two-color portion 6 at front side and the two-color portion 7 at the back side can respectively hide the under side color (62) of, the two-color portion at the same side and the under side color (72) of the two-color portion at another side by the upper color (61 and 71). That is, if both of the two-color portions 6 and 7 are comprised such that the colors (61 and 71) at the upper side are white and the colors (62 and 72) at the under side are red, the white color (61) of the two-color portion 6 at the front side hides both the red color (62) at the under side and the red color (72) at the under side of the two-color portion 7 at the back side and the white color (71) of the two-color portion 7 at the back side hides both the red color (72) at the under side and the red color (62) at the under side of the two-color portion 6 at the front side at once. The numeral 4 relates a port and the port 4 is attached to the first chamber 31.

The two-color portion 6 at the front side and the two-color portion 7 at the back side preferably have the same combination of colors at the upper side and the under side at the front and back side. As such a combination of colored layers, the combination in which the upper side is colored white or blue and the under side is colored red in order that the weak sealed portion is cleanly impressed before peeling and is conspicuous after peeling is preferable. Additionally, when the two-color portions 6 and 7 are provided on the adjacent position at the front and the back side, superimposing both of them is easy according to provide the two-color portions 6 and 7 disposed along the weak sealed portion 2. The two-color portions 6 and 7 may be provided on the films per se comprising the weak sealed portion 2 or provided on the surfaces of the films comprising the weak sealed portion 2. In the case that the two-color portions 6 and 7 are provided on the films per se, the films preferably have a plurality of layers and both of the colored surfaces may be adhered to each other. On the other hand, in the case that the two-color portions 6 and 7 are provided on the surfaces of the films, they may be formed by doubly applying the different colors at an upper side and an under side on the surfaces of the films or formed by adhering tapes having different colors at the front side and the back side on the surfaces of the films.

The plural-chamber container is changed to the state shown in FIG. 11 in which the weak sealed portion 2 is peeled by pressing from the outside. In this state, the colored layer 61 at the upper side of the two-color portion 6 at the front side and the colored layer 72 at the under side of the two-color portion 7 at the back side appear from a cross direction.

Therefore, if the colored layer 61 is colored a different color from the color of the colored layer 72, the communication of two chambers is absolutely confirmed by the appearance of the colored layer 72.

INDUSTRIAL APPLICABILITY

Since the plural-chamber container of the present invention includes means capable of indicating the fact that the partition wall is peeled on the partition wall forming portions of the opposed films, a medical professional can quickly become aware of whether or not the partition wall is peeled and the plurality of chambers is communicating with each other. In addition, since the means for indicating that the partition wall is peeled is indicated on both outer surfaces on the front side and the back side of the plural-chamber container, it is possible to quickly become aware of the fact that the partition wall is peeled even if the plural-chamber container would be set in any case, such as being placed or being hung, or the medical professional himself/herself who had peeled the partition wall of the plural-chamber container or another person uses the plural-chamber container thereafter.

The invention claimed is:

1. A plural-chamber container formed of a synthetic resin film and compartmentalized into a plurality of chambers by a peelable partition wall formed by thermally welding opposed parts of the films, characterized by comprising a means for indicating the peeling of the partition wall on the plural-chamber container, wherein said means for indicating the peeling of the partition wall is provided on outer surfaces of the partition wall forming portions of both of the opposed films, and includes:

a sign indicating portion provided on the partition wall forming portion on one of the opposed films, a sign shielding portion provided on the partition wall forming portion on the other of the opposed films, a sign which is printed on the sign indicating portion, and a drawing which corresponds to the outline of the sign on the sign indicating portion and is printed on the sign shielding portion, and in that when said partition wall is formed, the sign indicating portion and the sign shielding portion are superimposed and hence a sign is not indicated, and when the partition wall is peeled, the sign indicating portion and the sign shielding portion come apart from each other so that the sign is indicated by the sign indicating portion and the drawing is indicated by the sign shieding portion.

2. A plural-chamber container formed of a synthetic resin film and compartmentalized into a plurality of chambers by a peelable partition wall formed by thermally welding opposed parts of the films, characterized by comprising a means for indicating the peeling of the partition wall on the plural-chamber container, wherein said means for indicating the peeling of the partition wall is provided on outer surfaces of the partition wall forming portions of both of the opposed films, and including:

a sign indicating portion provided on the partition wall forming portion on one of the opposed films, a sign shielding portion provided on the partition wall forming portion on the other of the opposed films, a sign which is printed on the sign indicating portion, and a mesh pattern which is printed on the sign indicating portion as a background of the sign indicating portion, and a pattern which is printed on the sign shielding portion and fills gaps in the mesh pattern as the background of the sign indicating portion, and in that when said partition wall is formed, the sign indicating portion and the sign shielding portion are superimposed and hence a sign is not indicated, and when the partition wall is peeled, the sign indicating portion and the sign shielding portion come apart from each other so that the sign is indicated by the sign indicating portion.

* * * * *